US011358362B2

(12) United States Patent
Cheich et al.

(10) Patent No.: US 11,358,362 B2
(45) Date of Patent: Jun. 14, 2022

(54) DUNNAGE CONVERSION MACHINE AND METHOD

(71) Applicant: Ranpak Corp., Concord Township, OH (US)

(72) Inventors: Robert C. Cheich, Independence, OH (US); Jiri Sip, Strongsville, OH (US)

(73) Assignee: Ranpak Corp., Concord Township, OH (US)

( * ) Notice: Subject to any disclaimer, the term of this patent is extended or adjusted under 35 U.S.C. 154(b) by 95 days.

(21) Appl. No.: 16/341,127

(22) PCT Filed: Oct. 31, 2017

(86) PCT No.: PCT/US2017/059155

§ 371 (c)(1),
(2) Date: Apr. 11, 2019

(87) PCT Pub. No.: WO2018/071922

PCT Pub. Date: Apr. 19, 2018

(65) Prior Publication Data

US 2020/0180255 A1 Jun. 11, 2020

Related U.S. Application Data

(60) Provisional application No. 62/406,940, filed on Oct. 11, 2016.

(51) Int. Cl.
*B31D 5/00* (2017.01)

(52) U.S. Cl.
CPC ..... *B31D 5/0043* (2013.01); *B31D 5/0047* (2013.01); *B31D 5/0052* (2013.01);
(Continued)

(58) Field of Classification Search
CPC .. B31D 5/0043; B31D 5/0047; B31D 5/0052; B31D 2205/0005; B31D 2205/0041;
(Continued)

(56) References Cited

U.S. PATENT DOCUMENTS 5,569,146 A 10/1996 Simmons
5,871,429 A * 2/1999 Harding ..... B65B 55/20 53/472

(Continued)

FOREIGN PATENT DOCUMENTS

CN 110997302 A 4/2020
DE 102012018867 A 3/2014

OTHER PUBLICATIONS

The International Search Report and The Written Opinion of The International Searching Authority for Corresponding International Application PCT/US2017/059155 dated Mar. 9, 2018.

(Continued)

*Primary Examiner* — Chelsea E Stinson
(74) *Attorney, Agent, or Firm* — Renner, Otto, Boisselle & Sklar, LLP

(57) ABSTRACT

A dunnage conversion machine converts a sheet stock material into a dunnage product that is relatively thicker and less dense than the stock material. The conversion machine includes a conversion assembly that draws the sheet stock material therethrough and randomly crumples at least a portion of the sheet stock material. Before severing a discrete dunnage product of a desired length from the substantially continuous length of sheet stock material, the conversion assembly temporarily advances the sheet stock material therethrough while minimizing or eliminating the random crumpling of the sheet stock material in a reduced-crumpling zone, and then cuts the sheet stock material in the reduced-cutting zone to reduce or eliminate the production of scrap shards of sheet stock material.

5 Claims, 13 Drawing Sheets

(52) U.S. Cl.
CPC ..... *B31D 2205/0047* (2013.01); *B31D 2205/0058* (2013.01); *B31D 2205/0082* (2013.01); *B31D 2205/0088* (2013.01)

(58) Field of Classification Search
CPC .... B31D 2205/0047; B31D 2205/0058; B31D 2205/0088
USPC ..... 493/464
See application file for complete search history.

(56) References Cited

U.S. PATENT DOCUMENTS

| | | | | |
|---|---|---|---|---|
| 6,168,847 | B1 * | 1/2001 | Murphy | B31D 5/0047 428/128 |
| 7,258,657 | B2 * | 8/2007 | Ratzel | B31D 5/0047 493/464 |
| 9,884,465 | B2 * | 2/2018 | Sip | B31D 5/0043 |
| 2009/0082187 | A1 * | 3/2009 | Cheich | B65D 81/03 493/350 |
| 2013/0296154 | A1 * | 11/2013 | Sip | B31D 5/0047 493/464 |
| 2020/0139660 | A1 | 5/2020 | Corbin | |

OTHER PUBLICATIONS

Translation of First Office Action dated Jun. 1, 2020, for related Chinese National Phase Patent Application No. 201780062962.1.

* cited by examiner

DUNNAGE CONVERSION MACHINE AND METHOD

FIELD OF THE INVENTION

This application is a national phase of International Application No. PCT/US2017/059155, filed Oct. 31, 2017, and published in the English language, and which claims priority to U.S. Application No. 62/406,940 filed Oct. 11, 2016, both which are each hereby incorporated herein by reference in their entireties.

BACKGROUND

Dunnage conversion machines convert a stock material into a dunnage product that can be used to pack articles and thus minimize or prevent damage during shipment. The dunnage conversion machines, also referred to as dunnage converters, include a conversion assembly that converts a stock material into a relatively lower density dunnage product as the stock material moves through the conversion assembly from an upstream end toward an outlet at a downstream end.

Exemplary dunnage conversion machines already in use convert a sheet stock material into a dunnage product, and in the process randomly crumple at least a portion of the sheet stock material. Such dunnage conversion machines typically convert a substantially continuous length of sheet stock material into a strip of dunnage, from which discrete dunnage products are severed for use.

SUMMARY

The randomness of the crumpling of the sheet stock material has been found to create a potential problem in the severing operation. When a cutting blade moves through a plane across which a strip of dunnage extends, a randomly crumpled sheet can extend back and forth across the plane, resulting in loose shards of sheet material being producing as the cutting blade moves across the plane. These loose shards of material can build up, potentially increasing the potential for jamming, increasing waste, interfering with optical sensors, or simply making a mess on the floor.

The dunnage conversion machine and method provided by the present invention address this problem by temporarily reducing the random crumpling in a portion of the sheet stock material moving through the conversion assembly, and cutting the sheet stock material in a resulting reduced crumpling portion.

Paraphrasing the claims, the present invention provides a dunnage conversion machine for converting a sheet stock material into a relatively lower density dunnage product. The dunnage conversion machine includes a conversion assembly configured to advance a sheet stock material therethrough and to selectively randomly crumple at least a portion of the sheet stock material, a cutting assembly downstream of the conversion assembly; and a controller in communication with the conversion assembly and the cutting assembly. The controller is configured to control the conversion assembly to temporarily reduce the random crumpling in a portion of the sheet stock material and then activate the cutting assembly to sever a discrete strip of dunnage from the sheet stock material by cutting the strip of sheet stock material in the portion of the sheet stock material having the reduced crumpling.

The dunnage conversion machine may further include a conversion assembly that includes a feed assembly for advancing at least a first web of sheet stock material therethrough at a first rate; and a connecting assembly downstream of the feed assembly that (a) retards the advancement of the sheet stock material by passing the sheet stock material therethrough at a second rate that is less than the first rate, thereby causing the first web to randomly crumple in a longitudinal space between the feed assembly and the connecting assembly, and (b) connects the crumpled first web to a second web to maintain the crumpled first web in its crumpled state.

The feed assembly may include at least one pair of rotating members for advancing sheet stock material therebetween.

The connecting assembly may include at least one pair of rotating gear members having interlaced teeth for deforming the sheet stock material passing therebetween to interlock multiple plies of sheet stock material.

The conversion assembly may include one or more tunnel members that define a path for the sheet stock material through the conversion assembly.

The present invention also provides a method for converting a sheet stock material into a relatively lower density dunnage product. The method includes the steps of: (a) advancing a sheet stock material through a conversion assembly and randomly crumpling at least a portion of the sheet stock material to form a strip of dunnage; and then (b) temporarily advancing the sheet stock material through the conversion assembly without randomly crumpling the sheet stock material to form an uncrumpled portion of the strip of dunnage; and then (c) cutting the uncrumpled portion of the strip of dunnage to sever a discrete dunnage product from the strip of dunnage.

The randomly crumpling step may include (i) retarding the passage of the sheet stock material downstream of a feed assembly portion of the conversion assembly by passing the sheet stock material at a second rate that is less than the first rate to cause the first web to randomly crumple; and (ii) connecting multiple layers of sheet stock material, including connecting the crumpled first web to one side of a second web of sheet stock material, to hold the crumpled first web in its crumpled state.

The present invention also provides a dunnage conversion machine for converting a sheet stock material into a dunnage product that includes (a) means for advancing a sheet stock material and randomly crumpling at least a portion of the sheet stock material to form a strip of dunnage; (b) means for temporarily advancing the sheet stock material without randomly crumpling the sheet stock material to form an uncrumpled portion of the strip of dunnage; and (c) means for cutting the uncrumpled portion of the strip of dunnage to sever a discrete dunnage product from the strip of dunnage.

The means for advancing and the means for temporarily advancing the sheet stock material may include a conversion assembly having a feed assembly and a connecting assembly, and a suitable controller configured to control the feed assembly and the connecting assembly, as described herein.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

The present invention provides a dunnage conversion machine with a cutting assembly and a corresponding method for a dunnage conversion machine that converts a sheet stock material into a dunnage product that is relatively thicker and less dense than the stock material. The conversion machine includes a conversion assembly that draws the sheet stock material therethrough and randomly crumples at least a portion of the sheet stock material. Before severing a discrete dunnage product of a desired length from the substantially continuous length of sheet stock material, the conversion assembly temporarily advances the sheet stock material therethrough while minimizing or eliminating the random crumpling of the sheet stock material in a reduced-crumpling zone, and then cuts the sheet stock material in the reduced-cutting zone to reduce or eliminate the production of scrap shards of sheet stock material.

The randomness of the crumpling of the sheet stock material has been found to create a potential problem. When a cutting blade moves through a plane across which a strip of dunnage extends, a randomly crumpled sheet may extend back and forth across the plane, resulting in loose shards of sheet material being producing as the cutting blade moves across the plane. These loose shards of material can build up, potentially increasing the likelihood of jamming, increasing waste, interfering with optical sensors, or causing other problems.

The dunnage conversion machine and method provided by the present invention temporarily reduces the random crumpling in a portion of the sheet stock material moving through the conversion assembly, and then cuts the sheet stock material in the resulting reduced-crumpling portion.

The present disclosure includes drawings and descriptions of an exemplary dunnage conversion machine that produces a wrappable dunnage product, but the present invention is not limited to the illustrated dunnage conversion machine.

Figure 1:
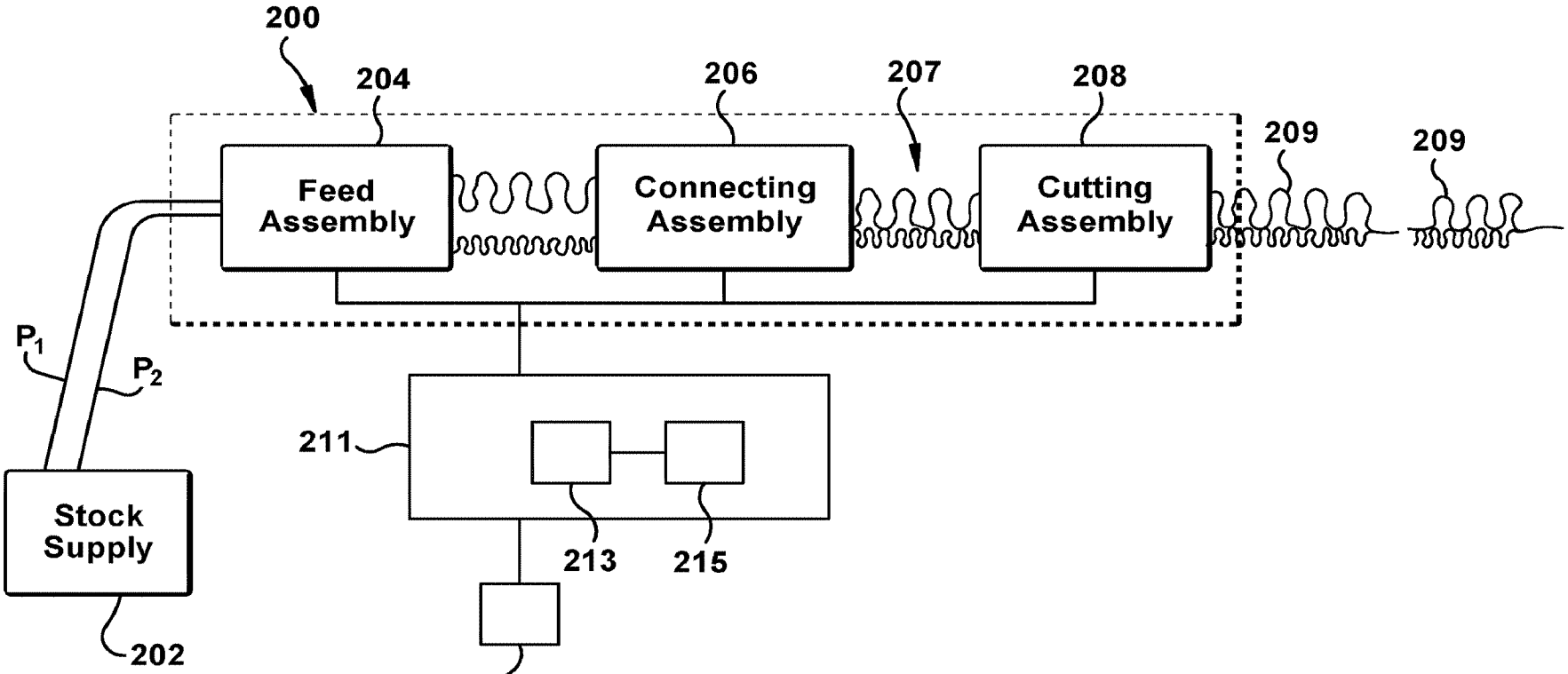
FIG. 1 is a schematic representation of an exemplary dunnage conversion machine provided in accordance with the present invention.
Figure 2:
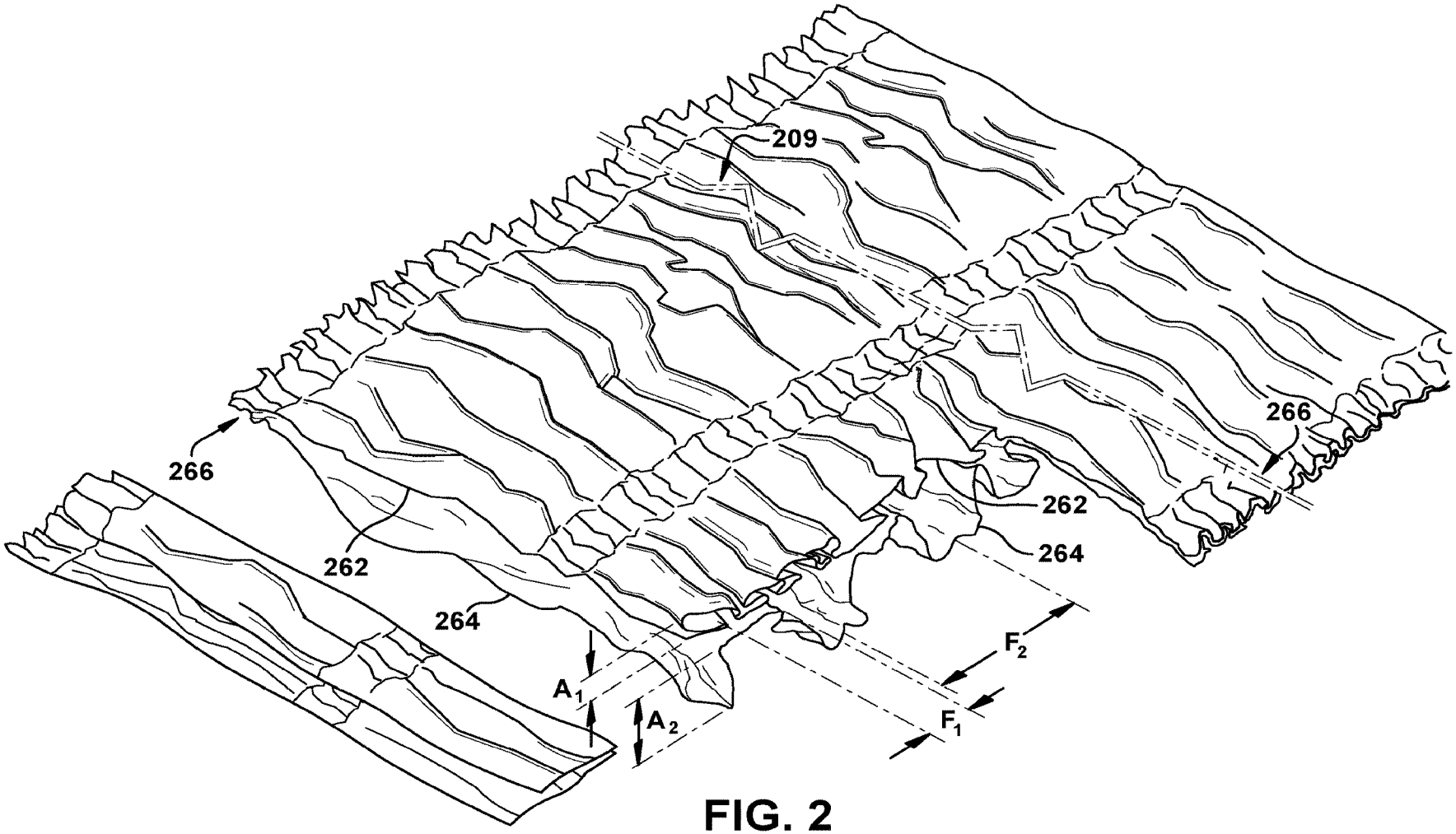
FIG. 2 is a schematic perspective view of a dunnage product produced by the dunnage conversion machine of FIG. 1.
Figure 3:
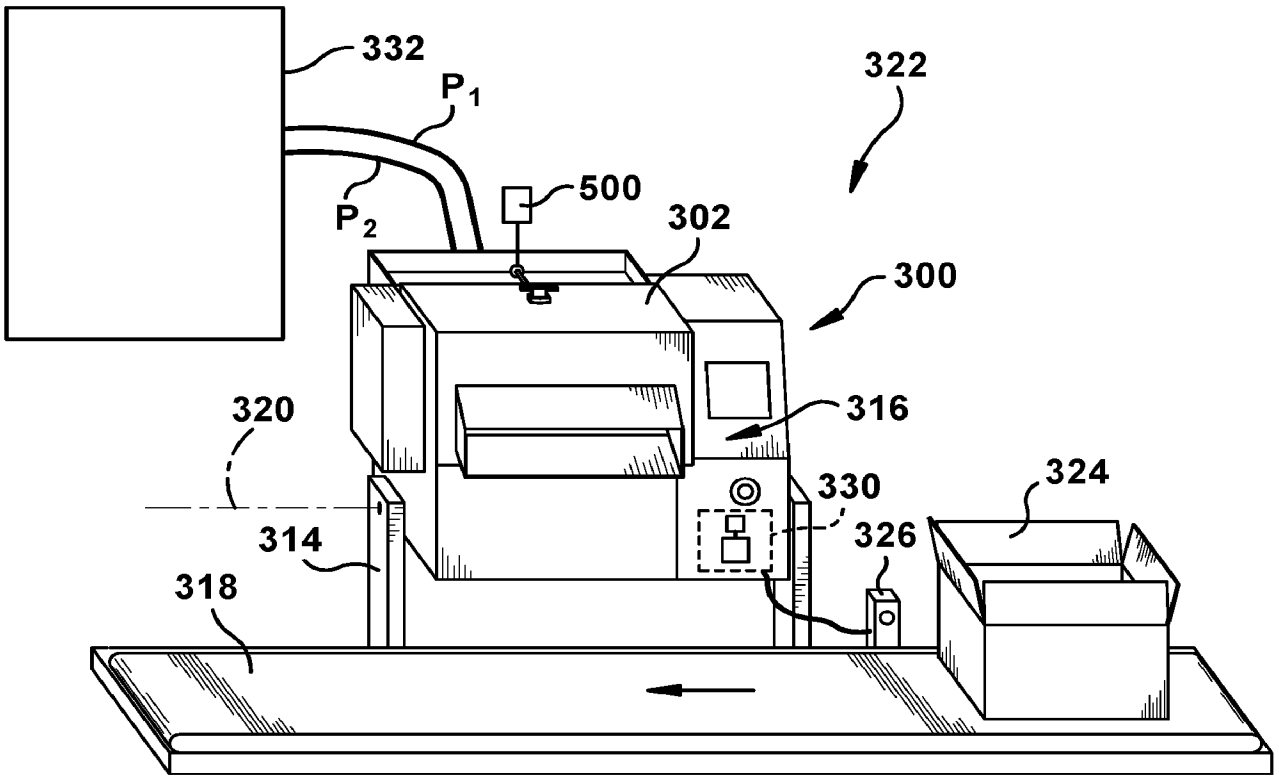
FIG. 3 is a schematic perspective view of a packaging system including a dunnage conversion machine provided in accordance with the present invention.
Figure 4:
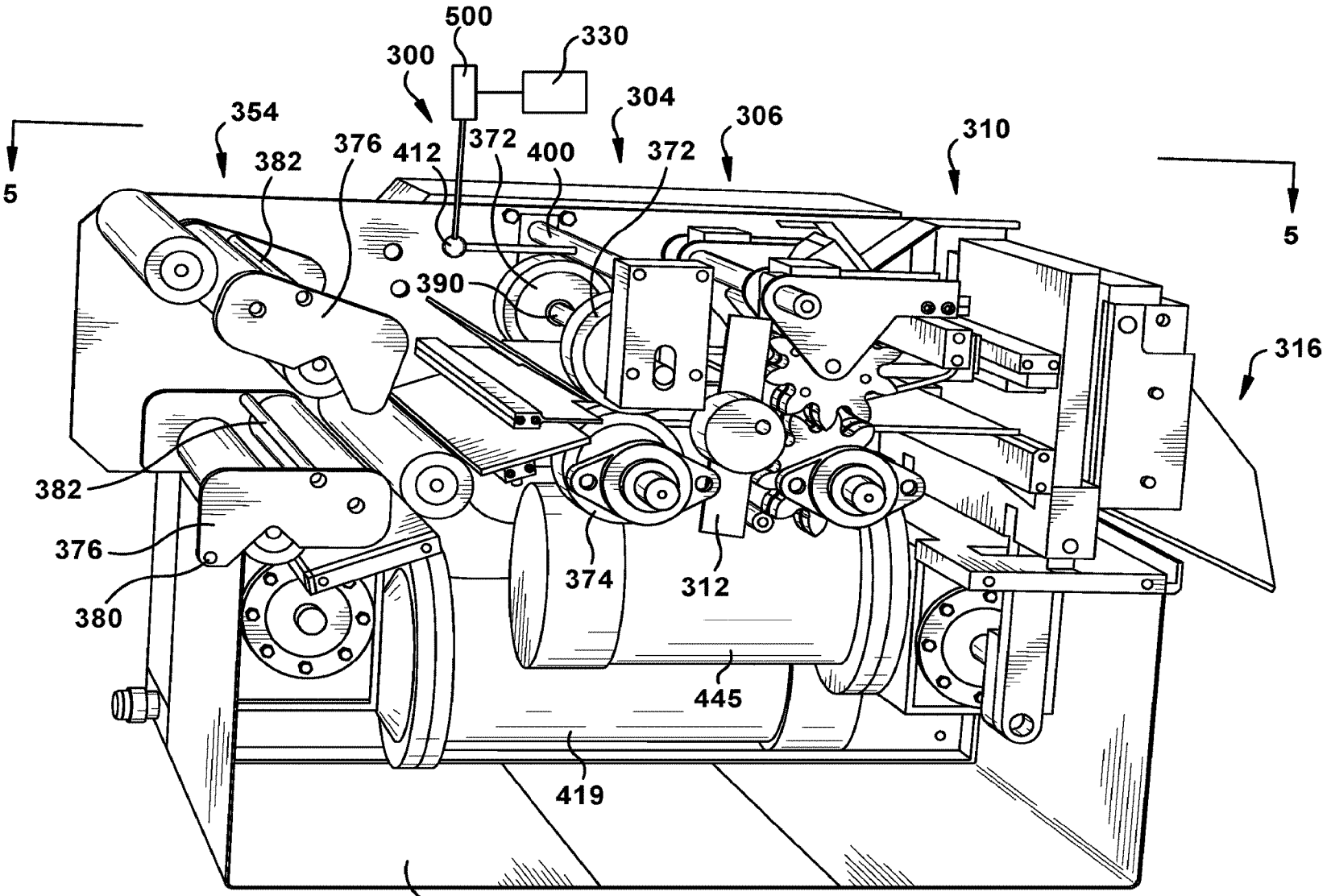
FIG. 4 is a perspective view of the dunnage conversion machine of FIG. 3 with the left side and top panels of its housing removed to reveal the internal components.
Figure 5:
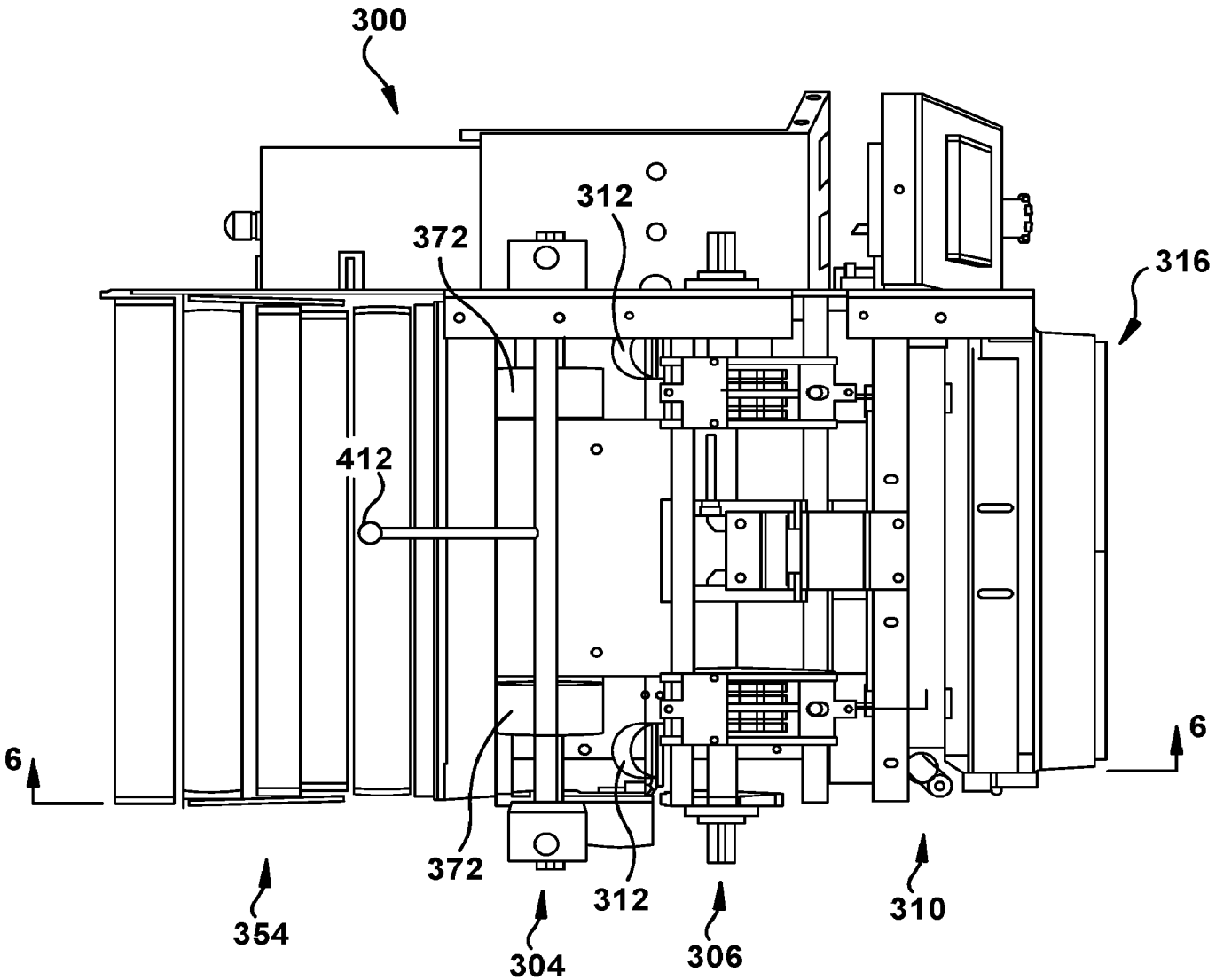
FIG. 5 is a top view of the dunnage conversion machine of FIG. 4, looking in direction 5-5 in FIG. 4.
Figure 6:
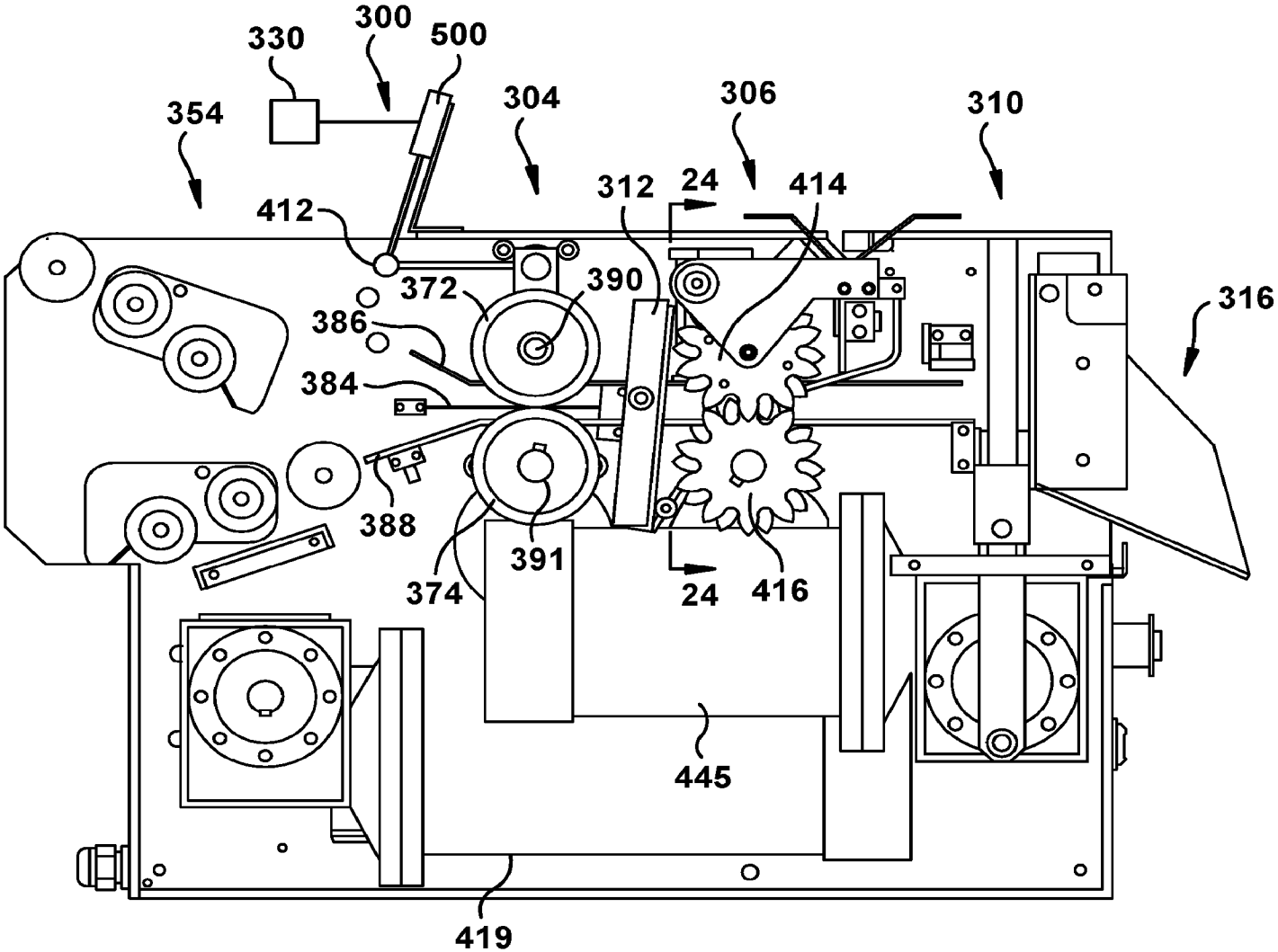
FIG. 6 is a cross-sectional side view of the dunnage conversion machine of FIG. 3, looking in direction 6-6 in FIG. 5.
Figure 7:
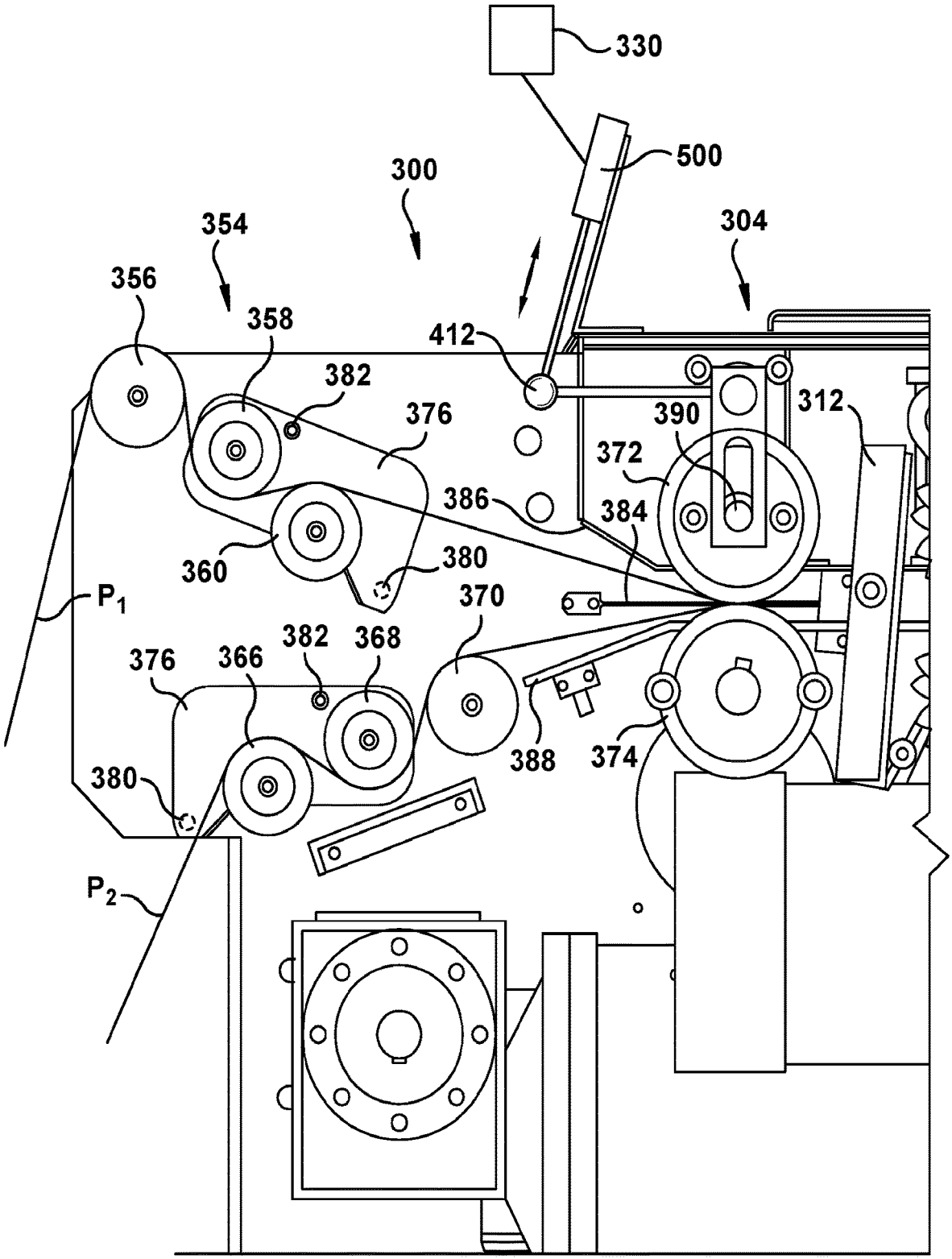
FIG. 7 is an enlarged side view of an upstream end of the dunnage conversion machine of FIG. 3.
Figure 8:
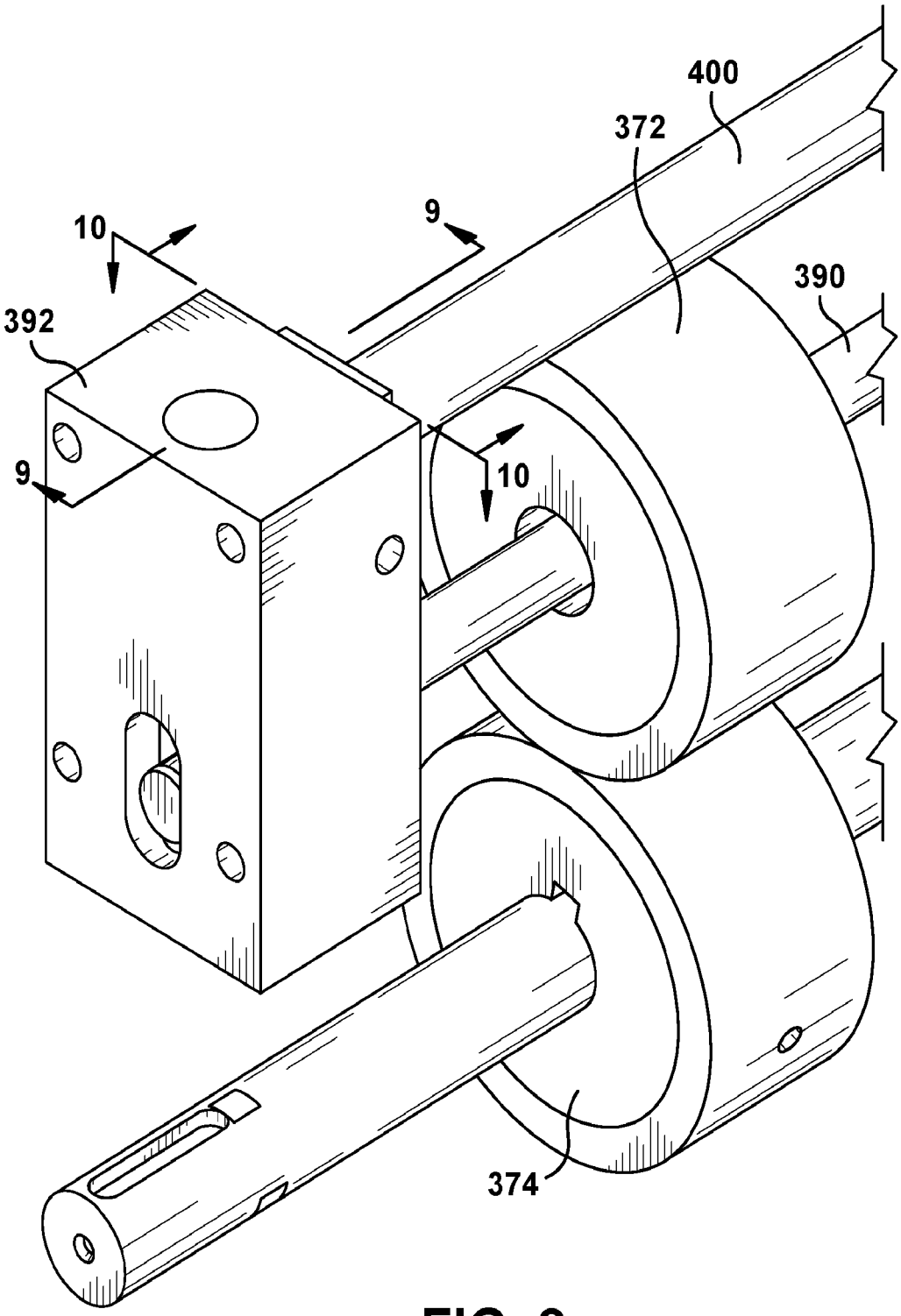
FIG. 8 is an enlarged schematic perspective view of a portion of a feed assembly of the dunnage conversion machine of FIG. 3.
Figure 9:
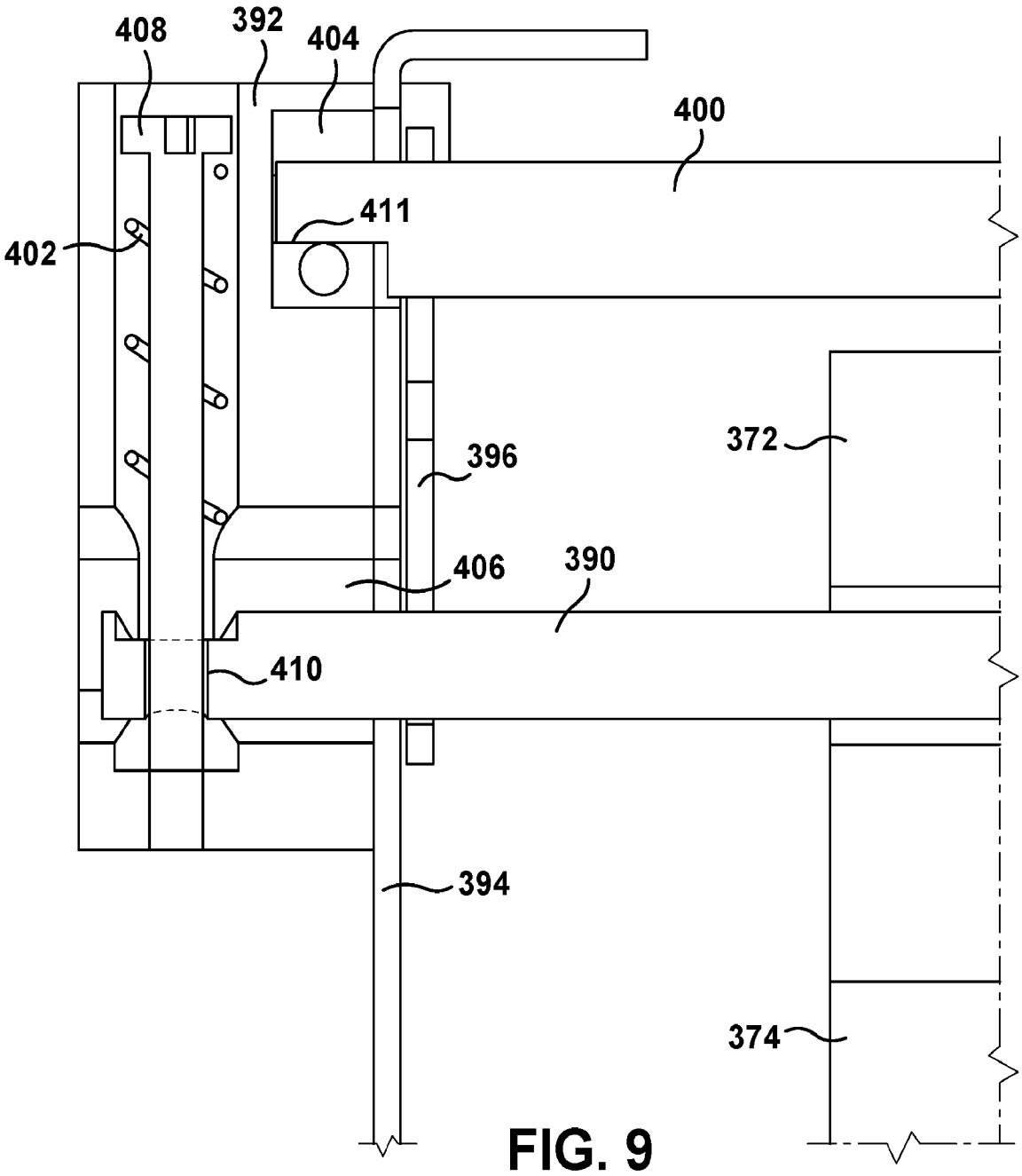
FIG. 9 is a cross-sectional view of FIG. 8 taken along lines 9-9 and looking in the indicated direction represented by the corresponding arrows.
Figure 10:
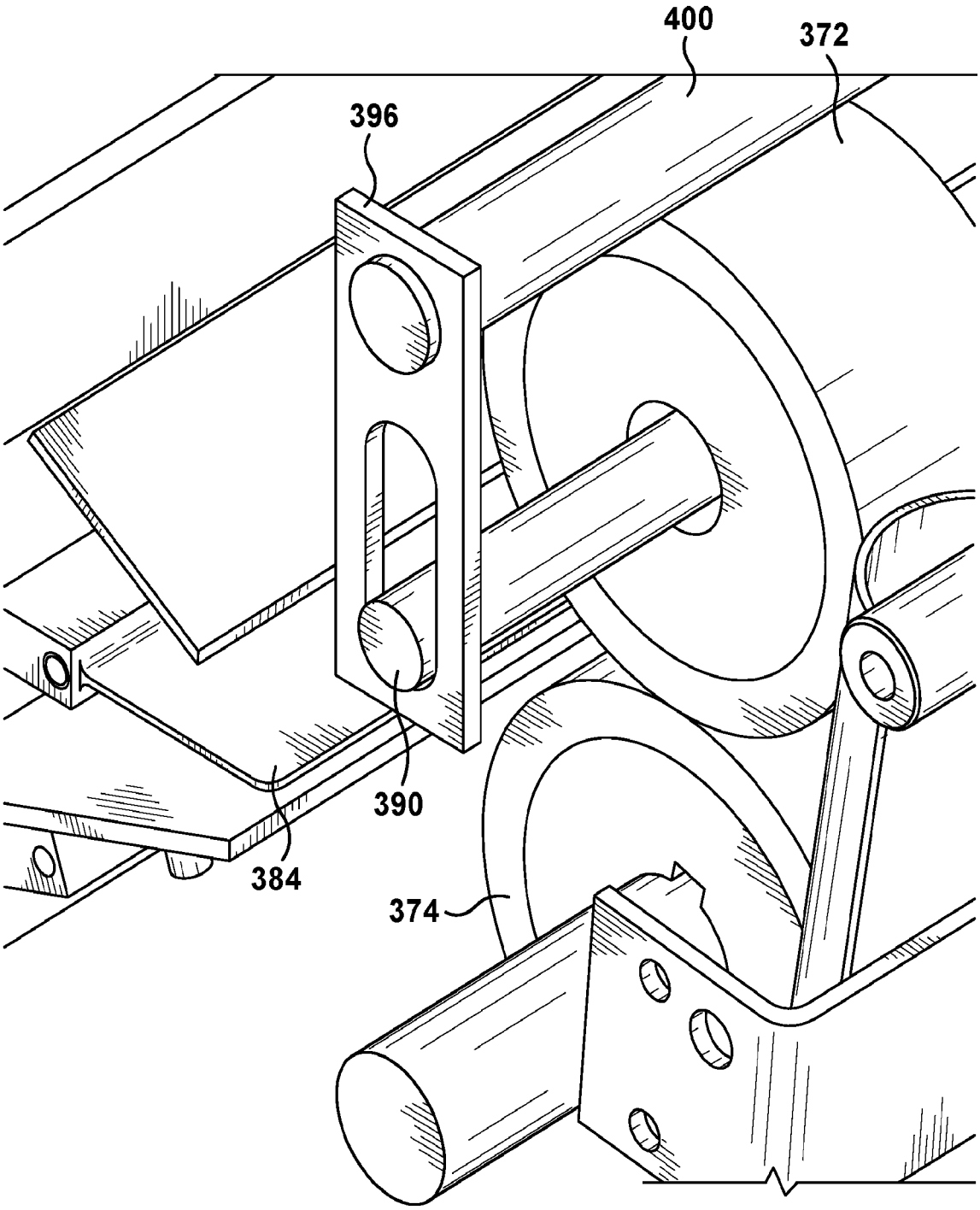
FIG. 10 is a cross-sectional view of FIG. 8 taken along lines 10-10 and looking in the direction indicated by the corresponding arrows.

Referring now to the drawings in detail, and initially FIG. 8, which shows a schematic dunnage conversion machine 200 provided in accordance with the present invention that converts a sheet stock material into a wrapping dunnage product. The dunnage conversion machine 200 includes a supply of sheet stock material 202, and a conversion assembly that includes both a feed assembly 204 that draws multiple plies $P_1$ and $P_2$ of sheet stock material from the supply, and a connecting assembly 206 downstream from the feed assembly 204 that connects multiple overlapping plies together to form a strip of dunnage 207. A suitable sheet stock material includes paper and/or plastic sheets, supplied as a roll or a fan-folded stack, for example. An exemplary sheet stock material for use in the conversion machine 200 includes either a single ply or a multi-ply kraft paper provided either in roll form or as a series of connected rectangular pages in a fan-folded stack. Paper is an environmentally-responsible choice for a sheet stock material because it generally is recyclable, reusable, and composed of a renewable resource. Multiple rolls or stacks may be used to provide the multiple sheets or webs of stock material for conversion to the multi-ply dunnage product, and subsequent rolls or stacks may be spliced to trailing ends of preceding rolls or stacks to provide a continuous length of sheet stock material to the dunnage conversion machine 200.

The connecting assembly 206 connects multiple overlying sheets of the stock material, including connecting at least one crumpled first sheet to one side of another or second sheet, to form a crumpled strip of dunnage. The second sheet may be a crumpled sheet that also passes through the feed assembly 204 or an uncrumpled sheet that bypasses the feed assembly 204.

The connecting assembly 206 typically passes the plies or sheets of stock material therethrough at a slower rate than the rate at which the plies are fed from the feed assembly 204, thereby cooperating with the feed assembly 204 to cause the stock material to randomly longitudinally crumple or fold in a confined space extending longitudinally between the feed assembly 204 and the connecting assembly 206.

The conversion machine 200 also includes a cutting assembly 208 downstream of the connecting assembly 206 that severs discrete lengths of a wrapping dunnage product 209 from the strip 207.

The converter 200 further includes a controller 211 that enables selection of a desired length of the dunnage product 209. The controller 211 typically includes a processor 213 a memory 215, and a program stored in the memory. The controller 211 also includes one or more input devices 217 for determining the selected length and one or more outputs for controlling elements of the conversion assembly, namely the feed assembly 204 and the connecting assembly 206, as well as the cutting assembly 208. The input devices 217 can be connected to or include one or more of a keyboard, mouse, touch screen display, a scanner or sensor, a bar code reader for reading a bar code on a container that receives the dunnage products, a radio frequency identification device (RFID) sensor, microphone, camera, etc. The controller 211 can be programmed to recognize the appropriate inputs that represent a selected length or identify a location to look up one or multiple lengths needed for a particular packing container.

The outputs from the controller 211 can control various motors that drive elements of the conversion assembly, such as the illustrated feed assembly 204, connecting assembly 206, and cutting assembly 208. In the embodiment shown in subsequent figures, the controller 211 also may control a solenoid motor, whose purpose will be further explained below.

In accordance with the present invention, the controller 211 is configured to selectively control operation of the feed assembly 204, such as by selectively engaging the feed assembly 204 to feed the sheet stock material therethrough as fast as or faster than the sheet material is being drawn through the connecting assembly 206 and thereby control whether or not the feed rate differential is sufficient to cause or minimize crumpling. In particular, the controller 211 may be configured to reduce or eliminate crumpling in a portion of the sheet material, even while continuing to advance the sheet material, and then cutting the sheet material in the reduced crumpling portion. The reduced crumpling portion extends across the width of the sheet stock material and extends a substantial length of the sheet stock material to account for variations in displacement of that reduced crumpling region from the conversion assembly to the cutting assembly 208. By reducing or eliminating crumpling in a portion of the sheet stock material that is to be cut by the cutting assembly 208, fewer loose shards of sheet material are created by the cutting operation.

Figure 11:
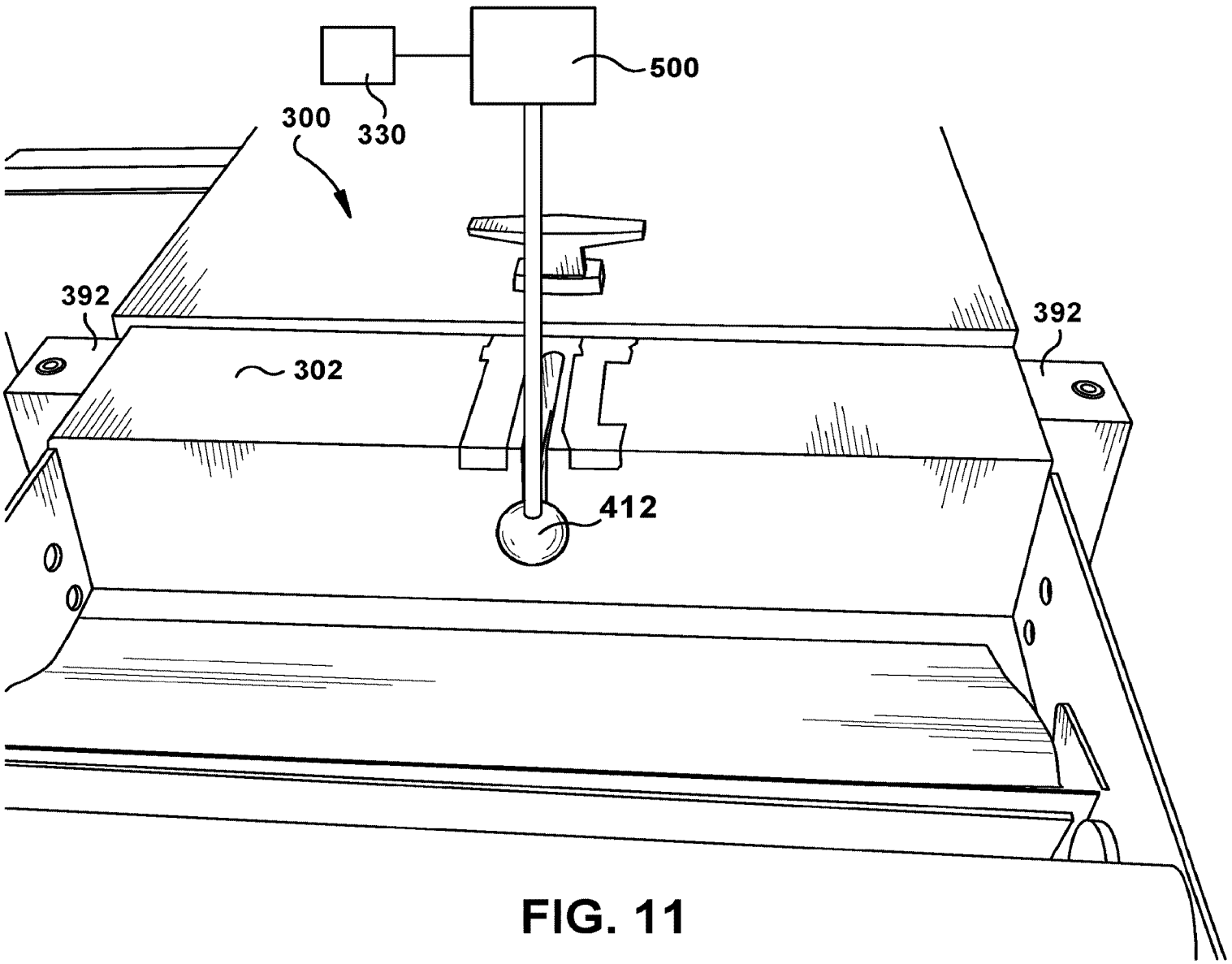
FIG. 11 is a perspective view of a rear, upper portion of the dunnage conversion machine of FIG. 3.
Figure 12:
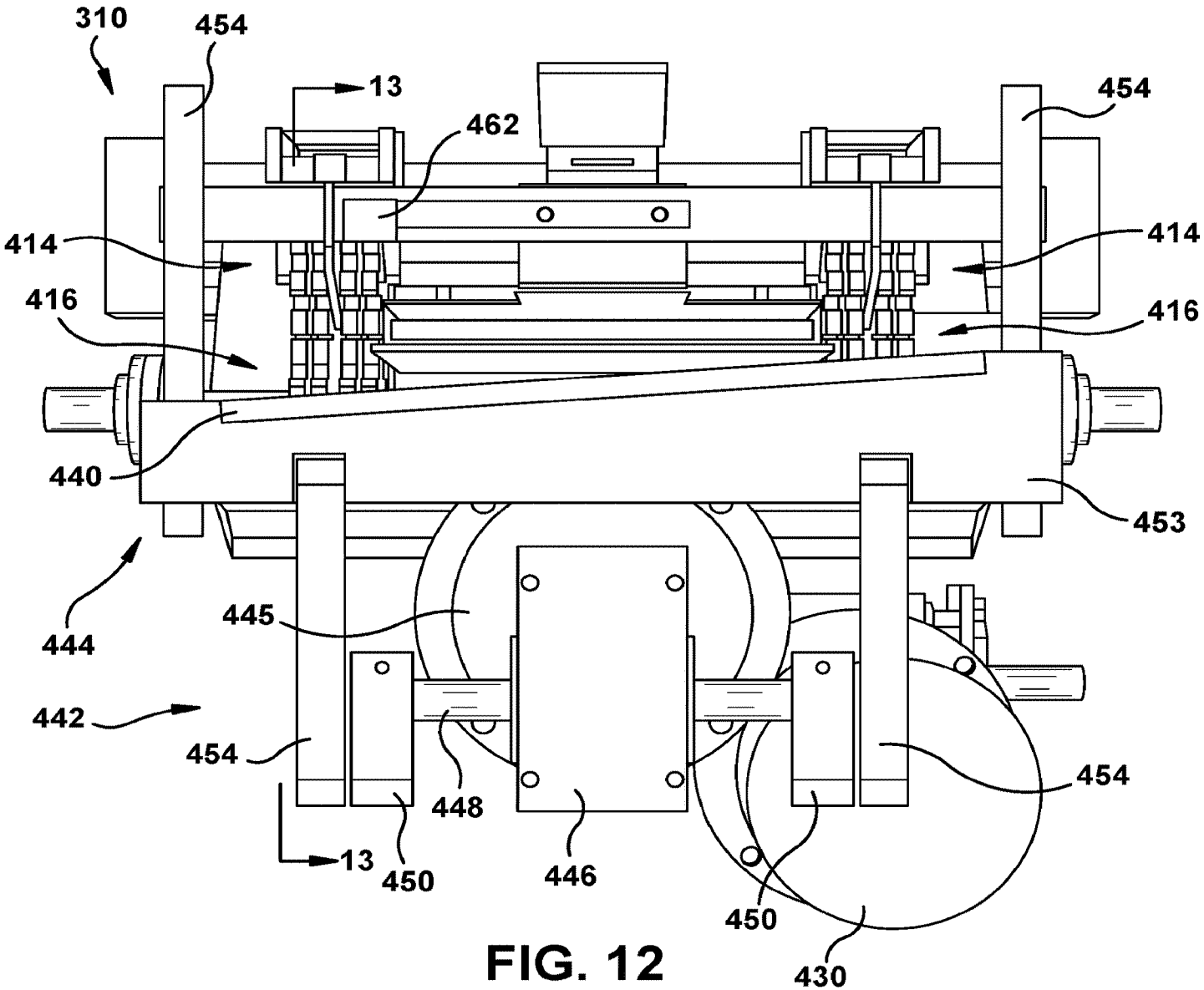
FIG. 12 is a front elevation view of a downstream portion of the dunnage conversion machine of FIG. 3 with the housing removed to reveal a cutting assembly.
Figure 13:
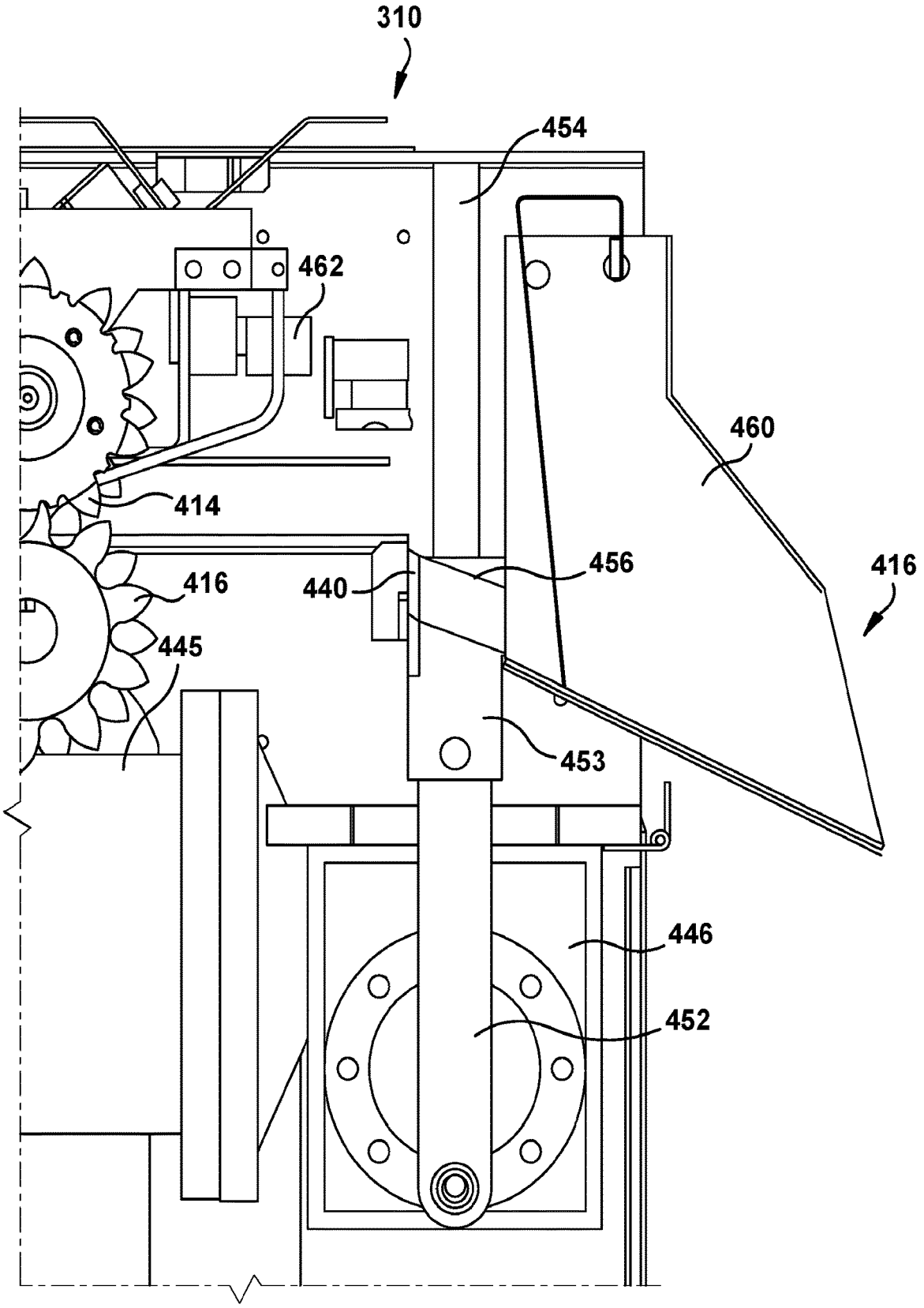
FIG. 13 is an enlarged cross-sectional view of the cutting assembly of FIG. 12 as seen along lines 13-13.

The resulting dunnage product 209, shown in FIG. 11, includes at least one, and preferably a plurality, of laterally-spaced, longitudinally-extending connecting bands 266 where the sheet stock material is embossed or pierced or punched or otherwise connected to hold multiple plies 262 and 264 of stock material together. The stock material generally is compressed in these connecting bands 266 and thus the crumpled plies 262 and 264 provide relatively greater loft in cushioning regions outside the connecting bands 266. If the crumpled portions are cut, the random nature of the crumpling may lead to the formation of loose shards of sheet stock material where the stock material crosses a plane through which a cutting mechanism acts. By reducing or eliminating the crumpling in a portion of the sheet material, the likelihood of generating loose shards of sheet stock material is greatly diminished.

A packaging system 322 including an exemplary dunnage conversion machine 300 is shown in FIGS. 12-15. The packaging system 322 includes the conversion machine 300, a conveyor 318 for transporting containers 324 to a packaging location adjacent an outlet 316, and a control sensor 326 mounted adjacent the conveyor 318 at a position upstream of the conversion machine 300. By measuring and/or inputting the conveyor speed, a controller 330 incorporated into the conversion machine 300 or remote from the conversion machine 300 can use a signal from the control sensor 326 to trigger a timer. The length of time from when the sensor 326 is triggered until a container 324 on the conveyor 318 is no longer sensed by the sensor 326 can be used to determine the length of the container 324 and thereby the length of an appropriate wrapping dunnage product. The controller 330 can automatically determine the appropriate length and control the conversion machine 300 to dispense the wrapping dunnage product directly to the container. The controller 330 is essentially the same as the controller 211 described above.

A suitable application for such a system 322 would arise when a wrapping dunnage product will be used as a bottom or top layer in the container. Consequently, the production of a wrapping dunnage product for layering in a container can be automated and a wrapping product of the appropriate length can be provided automatically and on demand in a more compact configuration than a pre-produced supply of wrapping dunnage material.

The dunnage conversion machine 300 generally includes a housing 302 that surrounds or incorporates both a conversion assembly that includes a feed assembly 304 and a connecting assembly 306, and a cutting assembly 306. The housing 302 is mounted to a stand 314 to raise the outlet 316 of the housing 302 above a packaging surface provided by the conveyor 318.

The illustrated conversion machine 300 includes a series of serpentine guides 354, typically formed of bars or rollers with parallel spaced axes, upstream of the feed assembly 304. These guides 354 define a serpentine path for the sheet stock material as it travels from a supply or supplies to the feed assembly 304. These guides 354 help to provide a relatively consistent tension on the stock material coming from the supply, particularly when the supply includes a fan-folded stock material. The guides 354 also may improve tracking, so that the stock material enters the feed assembly 304 in a more consistent lateral location.

From the serpentine guides 354, each ply $P_1$ and $P_2$ enters the feed assembly 304 on a respective side of a separator plate 384 that extends between rotating members, such as wheels 372 and 374, of the feed assembly 304 and defines a passage for each ply $P_1$ and $P_2$ between upper and lower channel guides 386 and 388. The channel guides 386 and 388 flare outward, away from one another, at an upstream end to receive the plies, and then extend parallel to each other through the feed assembly 304 and the connecting assembly 306 to guide the stock material therethrough to the cutting assembly 310. The channel guides 386 and 388 also confine the stock material between the feed assembly 304 and the connecting assembly 306.

At an upstream end of the feed assembly 304 at least one ply is separated from at least one other ply. Typically only two plies $P_1$ and $P_2$ are used, and the two plies follow different paths into the feed assembly 304. This is accomplished with a separator 384 extending therefrom in a downstream direction into the feed assembly 304 and between laterally spaced-apart rotating members or wheels 372 and 374 that form part of the feed assembly 304. These rotating member pairs 372 and 374 are laterally spaced on opposite sides of the separator 384 or engage one another through laterally-spaced openings in the separator 384.

Above and below the separator 384, upper and lower channel guide members 386 and 388 or channel guide plates define a path through the feed assembly 304 and the connecting assembly 306 that constrain movement of the sheet stock material passing between the feed assembly 304 and the connecting assembly 306. These channel guide members 386 and 388 define the upper and lower boundaries that confine the sheet stock material therein to facilitate the crumpling of the stock material between the feed assembly 304 and the slower speed connecting assembly 306. In addition, the separator 384 generally is parallel to the upper and lower guide members 386 and 388, but may be closer to one of the guide members 386 and 388. Consequently, the stock material passes on either side of, in this case above and below the separator 384, whereby the stock material on either side will fold and crumple randomly and asymmetrically. Longitudinal crumpling creates fold lines extending approximately transverse the longitudinal dimension of the stock material, which generally is perpendicular to the path of the stock material through the machine 300. The sheet stock material thus contained between the feed assembly 304 and the slower connecting assembly 306 is randomly crumpled, creating fold lines with random lengths and orientations, and an irregular pitch between the folds.

The asymmetrical folding and crumpling provided by the different spacing of the channel guide members 386 and 388 and the separator 384 yields two differently crumpled sheets generally having waveforms with independent frequencies and amplitudes in the irregular crumpling of the sheet material. Accordingly, the different size ply in-feed chambers or passages defined by the channel guide members 386 and 388 and the separator 384 allow the plies to randomly crumple with different frequencies and amplitudes so the plies are less likely to interlock when they are brought together, thereby providing more loft after the plies are connected. Without the separator 384, the plies would nest into each other to create a thinner, less supportive dunnage product.

The feed assembly 304 includes upper and lower rotating member 372 and 374 that form pairs of laterally-spaced rotating members, in this case wheels, for advancing the sheet stock material therebetween. The upper rotating members 372 engage and advance an upper ply of sheet material and the lower rotating members 374 engage and advance a lower ply of sheet material. The rotating members 372 and 374 are mounted on respective common laterally-extending shafts 390 and 391, and the upper rotating members 372 are pivotably mounted and biased against the lower rotating members 374.

The rotating members 372 and 374 have a surface that provides sufficient friction to grip the stock material, and may be knurled or have a rubber or other high-friction surface, for example, to provide the desired grip on the stock material. The feed assembly 304 may include one pair of rotating members, a single rotating member on one side of the sheet stock material and multiple rotating members on the other side of the stock material, or as shown, multiple laterally-spaced pairs of rotating members 372 and 374 for advancing the sheet stock material therethrough. The opposing rotating members 372 and 374 in each pair preferably, but not necessarily, are biased against one another to maintain a grip on the sheet stock material passing therebetween.

Referring now to FIG. 22, the wheel shaft 390 is supported at its lateral ends by a pair of opposing housing blocks 392 mounted outside the lateral side plate frame members 394, a pair of lifting plates 396 inward of the housing blocks 392, and a lifting cam shaft 400. Each housing block 392 houses a compression spring 402 to bias the upper and lower rotating members or wheels 372 and 374 toward one another. The housing block 392 has a recess or pocket 404 that receives an end of the lifting cam shaft 400 and holds it in place, and through-slots 406 that allows the wheel shaft 390 to translate vertically on parallel guides. The wheel shaft 390 has a hole 410 near its end where a bolt 408 passes through to act as a spring compressor as well as the guide for linear movement of the wheel shaft 390.

The lifting cam shaft 400 is in-line with, parallel to, and above the wheel shaft 390 in the illustrated embodiment. The lifting shaft 400 spans the full width of the feed assembly 304 and its lateral ends are captured within the pockets 404 in the housing blocks 392. One side of each end of the lifting cam shaft 400 is milled down to a flat 411 such that the lifting cam shaft 400 sits below its tangency on the flats 411 in the pockets 404 of the housing blocks 392. The lifting plates 396 have a clearance hole for the cam shaft 400 and a slot for the wheel shaft 390 to allow the translation motion of the wheel shaft therein.

A hole toward the center of the lifting cam shaft 400 receives a lever arm 412 that can extend outside the housing 302 of the conversion machine 300. The hole and the lever arm 412 are parallel to the flats 411 in the illustrated embodiment. Rotating the lever arm 412 through ninety degrees from an operating position to a loading position rotates the ends of the cam shaft 400 off their flats 411 onto their round portions. The lifting plates 396 transfer this rotational motion to the wheel shaft 390, and thus to the upper rotating members or wheels 372, thereby providing a gap between the upper and lower wheels 372 and 374, between which the sheet stock material can be fed without obstruction all the way to rotating gears 414 and 416 in the connecting assembly 306 (FIG. 15). Once the stock material is loaded, returning the lever arm 412 to its operating position closes the gap between the upper and lower wheels 372 and 374 of the feed assembly 304. In the operating position, the spring 402 biases the shaft 390 of the upper wheels 372 toward against the lower wheels 374, now with the stock material therebetween.

The dunnage conversion machine 300 may further include laterally spaced-apart forming plows 312 between the feed assembly 304 and the connecting assembly 306 that reduce the width of the stock material and inwardly fold the free lateral edges as the stock material passes thereby. The forming plows 312 each have a curved surface that is mounted to extend into the path of the lateral edges of the stock material, gradually protruding further inward toward a downstream end thereof. As the lateral edges of the stock material are folded or turned inwardly by the lateral plows 312, the edges of the stock material of one layer can fold around and enclose the edges of the other layer, and the connecting assembly 306 then mechanically connects the overlapping layers together. This makes the lateral edges of the finished dunnage product more uniform, and the additional folding and the resulting additional layers passing through the connecting assembly 306 to form the connecting lines helps to hold the dunnage product together better. The conversion machine 300 defined by this feed assembly 304 and connecting assembly 306 provides approximately 40-55% crimp loss. This means that the wrap dunnage product that is produced is approximately 40-55% shorter than the stock material that is used to produce it.

The connecting assembly 306 includes paired rotating gear members or gears 414 and 416 that are biased together and connect the overlapped layers of stock material as the stock material passes between the gears. The illustrated connecting assembly 306 includes at least two rotating gear members 414 and 416 having interlaced teeth for deforming the sheet stock material passing therebetween, thereby mechanically interlocking multiple layers and multiple overlapping sheets along lines of connection to hold them together as a connected strip of dunnage. This mechanical connection is distinguished from a chemical or adhesive bond between the layers. The gear members 414 and 416 flatten, crease, fold, and/or punch the stock material as it passes therebetween. Although the connecting assembly 306 includes at least two rotating gear members 414 and 416 between which the stock material is fed, more gear members may be employed in various configurations.

The upper gears 414 are biased against the lower gears 416 by a biasing member, such as a spring. The biased rotating members 372 and 374 of the feed assembly 304 and the biased gears 414 and 416 of the connecting assembly 306 are each mounted in a cantilever fashion for rotation about respective pivots 240 and 241 so that a smaller spring can be used to provide sufficient biasing force.

The rotating gear members 414 and 416 generally are driven at a rate that is less than the rate that the feed assembly 304 advances the sheet stock material thereto to produce the desired random crumpling in the confined space between the feed assembly 304 and the connecting assembly 306. In the illustrated conversion machine 300, the feed assembly 304 and the connecting assembly 306 are driven by a common electric drive motor 242. The drive motor 242 positively drives the lower rotating members 374 of the feed assembly 304 and is connected to the lower gear members 416 of the connecting assembly 306 via a chain and suitable sprocket (not shown). The ratio of the speed between the rotating members 372 and 374 of the feed assembly 304 and the gears 414 and 416 of the connecting assembly 306 can readily be adjusted by adjusting the relative sizes of the sprockets and providing a suitable chain therebetween. Alternatively, separate motors can be provided to separately drive the feed assembly 304 and the connecting assembly 306. A transmission also may be provided instead of the chain drive, to provide the ability to change the relative speeds of the feed wheels 372 and 374 and the gears 414 and 416 without interrupting their operation.

To obtain the desired length of dunnage products, the conversion machine 300 includes the cutting assembly 310 downstream of the connecting assembly 306 for cutting or otherwise severing a discrete dunnage product having a desired length from the substantially continuous length of sheet stock material drawn from the supply. The cutting assembly 310 may include a rotatable cutting wheel, for example, that is movable across the path of the sheet stock material and a stationary blade against which the cutting wheel acts to cut the crumpled strip of dunnage therebetween. The cutting assembly 319 is not limited to use of a rotatable cutting wheel, however.

As shown in the illustrated embodiment, a separate cut motor 244 drives a guillotine-style cutting assembly 208 which includes a cutting blade 246 that extends across the width of the path of the dunnage strip and has a pair of crank arms 248 aligned with the laterally-spaced rotating members 216 and 218 of the feed assembly 204 and the gears 236 and 238 of the connecting assembly 206 to positively drive the cutting blade 246 through the layers of crumpled stock material with the most force applied at the lines of connection. The crank arms 248 are connected to a common shaft 250 and rotate through a cycle defined by respective cams 252.

The cutting assembly 310 includes a guillotine-style cutting blade 440 whose movement is directed by a twin four-bar linkage 442 and a slider assembly 444. A separate cut motor 445 drives the four-bar linkage 442 via a gear box 446. A drive shaft 448 symmetric about the gear box 446 has a drive crank 450 on opposing ends of the shaft 448. Each drive crank 450 is attached to a second crank 452 which in turn attaches to a carriage 453 that supports the cutting blade 440. The cutting blade carriage 453 rides on a pair of parallel shafts or slider arms 454 to guide the cutting blade 440 as it moves across the path of the strip of dunnage to sever a discrete length of a wrapping dunnage product from the strip. Each of the crank arms 450 is aligned with one of the laterally-spaced gear pairs 414 and 416 of the connecting assembly 306 to concentrate the force applied to cutting the strip of dunnage at the connecting lines, which are the areas of maximum resistance to being cut.

The cutting blade carriage 453 has an angled surface 456 behind the blade edge. This angle removes any flat surface upon which slivers of the cut dunnage product could rest. From the cutting blade 440, the housing exit chute 460 continues a downward slope out of the machine 300. This allows the next strip of dunnage formed in series to sweep out the remnants from the previous strip of dunnage.

In summary, during the formation of randomly-crumpled dunnage products, loose shards of sheet stock material may be generated when the dunnage products are cut to a desired length. These shards can cause problems, both aesthetic and in the proper function of the dunnage conversion machine 300. The present invention provides a way to minimize or eliminate this problem. One solution is to lift the upper feed wheels 372 from the lower feed wheels 374 before the dunnage product is cut, for example using a solenoid motor 500 connected to the lever arm 412. The controller 330 is connected to and otherwise is configured to control the solenoid motor 500 to disengage the upper feed wheels 372 from the lower feed wheels 374. This causes the feed assembly 304 to disengage from the stock material, whereby only the connecting assembly 306 is drawing the sheet material through the conversion assembly. Alternatively, the feed assembly 304 could be controlled to feed sheet stock material at the same or a slower feed rate than the connecting assembly 306 to minimize or eliminate longitudinal crumpling in a portion of the strip of dunnage. With either of these techniques, crumpling is reduced or eliminated in a portion of the sheet stock material while in effect. This reduced-crumpling zone is flatter and has less cushioning ability than a regularly-crumpled portion of the sheet stock material. This reduced-crumpling portion can then be cut once the connecting assembly 306 advances the reduced-crumpling portion to the cutting assembly 310. The lower amount of crumpling greatly decreases the likelihood that loose shards of sheet material will be generated during the cutting operation.

Accordingly, a dunnage conversion machine provided by the invention converts a sheet stock material into a dunnage product that is relatively thicker and less dense than the sheet stock material. The conversion machine includes a conversion assembly that draws the sheet stock material therethrough and randomly crumples at least a portion of the sheet stock material. Before severing a discrete dunnage product of a desired length from the substantially continuous length of sheet stock material, the conversion assembly temporarily advances the sheet stock material therethrough while minimizing or eliminating the random crumpling of the sheet stock material in a reduced-crumpling zone, and then cuts the sheet stock material in the reduced-cutting zone to reduce or eliminate the production of scrap shards of sheet stock material. A solenoid may be used to lift the upper feed wheels 372 to reduce or eliminate the crumpling.

Although the invention has been shown and described with respect to a certain illustrated embodiment or embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention.

The invention claimed is:

1. A dunnage conversion machine for converting a sheet stock material into a relatively lower density dunnage product, comprising:

a conversion assembly configured to advance a sheet stock material therethrough and to selectively randomly crumple at least a portion of the sheet stock material to form a strip of dunnage;

a cutting assembly downstream of the conversion assembly to sever discrete dunnage products from the strip of dunnage; and a controller in communication with the conversion assembly and the cutting assembly;

wherein the controller is configured to control the conversion assembly to form a randomly-crumpled portion of the strip of dunnage with a first amount of crumpling and a reduced-crumpling portion of the strip of dunnage with a second amount of crumpling that is less than the first amount and then activate the cutting assembly to sever a discrete strip of dunnage from the sheet stock material by cutting the strip of sheet stock material in the reduced-crumpling portion of the strip of dunnage.

2. A dunnage conversion machine as set forth in claim 1, where the conversion assembly includes:

a feed assembly for advancing at least a first web of sheet stock material therethrough at a first rate; and a connecting assembly downstream of the feed assembly that (a) retards the advancement of the sheet stock material by passing the sheet stock material therethrough at a second rate that is less than the first rate, thereby causing the first web to randomly crumple in a longitudinal space between the feed assembly and the connecting assembly, and (b) connects the crumpled first web to a second web to maintain the crumpled first web in its crumpled state.

3. A conversion machine as set forth in claim 2, wherein the feed assembly includes at least one pair of rotating members for advancing sheet stock material therebetween.

4. A conversion machine as set forth in claim 2, wherein the connecting mechanism includes at least one pair of rotating gear members having interlaced teeth for deforming the sheet stock material passing therebetween to interlock multiple plies of sheet stock material.

5. A conversion machine as set forth in claim 1, wherein the conversion assembly includes one or more tunnel members that define a path for the sheet stock material through the conversion assembly.

* * * * *